US006864855B1

(12) United States Patent
Fujita

(10) Patent No.: US 6,864,855 B1
(45) Date of Patent: Mar. 8, 2005

(54) DISH ANTENNA ROTATION APPARATUS

(75) Inventor: Kenichi Fujita, Kobe (JP)

(73) Assignee: DX Antenna Company, Limited, Hyogo-Ken (JP)

( * ) Notice: Subject to any disclaimer, the term of this patent is extended or adjusted under 35 U.S.C. 154(b) by 0 days.

(21) Appl. No.: 10/684,698

(22) Filed: Oct. 14, 2003

(30) Foreign Application Priority Data

Sep. 11, 2003 (JP) ..... 2003-319524

(51) Int. Cl.[7] ..... H01Q 3/02
(52) U.S. Cl. ..... 343/882; 343/878; 343/840
(58) Field of Search ..... 343/840, 878, 343/882, 890, 892; 248/514, 910

(56) References Cited

U.S. PATENT DOCUMENTS

| | | | | |
|---|---|---|---|---|
| 5,526,010 A | * | 6/1996 | Plunk | 343/882 |
| 5,941,497 A | * | 8/1999 | Inoue et al. | 248/514 |
| 6,188,372 B1 | | 2/2001 | Jackson et al. | 343/882 |
| 6,445,361 B2 | | 9/2002 | Liu et al. | 343/882 |
| 6,762,731 B1 | * | 7/2004 | Chou | 343/882 |

* cited by examiner

*Primary Examiner*—Tan Ho
(74) *Attorney, Agent, or Firm*—Duane Morris LLP

(57) ABSTRACT

A bracket (12) is fixed to the rear surface of a reflector (2). The bracket has a planar plate (14) which, when the bracket is fixed to the reflector, is perpendicular to a polarity axis (16). Plural, spaced-apart arcuate slots (20) arranged on an imaginary circle on the planar plate (14) about the polarity axis (16) are formed in the planar plate (14). An adapter plate (24) is disposed in contact with the surface of the planar plate (14) facing the reflector (2). The bracket (12) is rotatable about the polarity axis (16) relative to the adapter plate (24). The adapter plate (24) has screw holes (26) in alignment with the arcuate slots (20) in the planar plate (14). A bracket (28) is disposed on the side of the planar plate (14) opposite to the reflector (2). The bracket (28) has a pair of wings (30, 32). A connecting member (34) is formed integral with the wings (30, 32). The connecting member (34) is perpendicular to the wings (30, 32). The bracket (28) is rotatable about an elevation adjustment axis passing between the wings (30, 32). The bracket (28) has tabs (36, 38, 40). The tabs (36, 38, 40) are adapted to contact the planar plate (14) and provided with respective holes (42, 44, 46). Bolts (48) are inserted through the respective holes (42, 44, 46) and the respective arcuate slots (20) and screwed into the screw holes (26) in the adapter plate (24), whereby the brackets (12, 28) are secured to the adapter plate (24).

4 Claims, 5 Drawing Sheets

DISH ANTENNA ROTATION APPARATUS

This invention relates to a dish antenna rotation apparatus which allows adjustment of the rotation angle of a dish antenna.

BACKGROUND OF THE INVENTION

A multi-beam antenna may be used to receive signals from a plurality of stationary satellites, such as communications satellites and broadcasting satellites. A multi-beam antenna uses a multi-beam antenna rotation apparatus for adjusting the antenna to predetermined elevational, azimuth and rotation angles. An example of such multi-beam antenna rotation apparatus is disclosed in, U.S. Pat. No. 6,445,361 which issued on Sep. 3, 2002.

The antenna rotation apparatus disclosed in U.S. Pat. No. 6,445,361 includes a dish bracket, an elevation bracket and azimuth clamp. The dish bracket is fixed to the back of the dish antenna. A plurality of spaced-apart arcuate slots are formed in the dish bracket, being arranged on an imaginary circle drawn on the dish bracket. The dish bracket is provided with a projection at the center of the imaginary circle, which projects in the direction away from the dish antenna. The elevation bracket has a pair of wings which are connected together by a bottom formed integral with the wings. A hole is formed in the bottom, into which the projection of the dish bracket is fitted. Thus, the elevation bracket is rotatable about the projection so that the rotation angle of the dish antenna with the dish bracket can be adjusted to a desired rotation angle. Tabs are formed in the respective wings and are provided with bolt holes. After the dish antenna is rotated to the desired rotation angle, bolts are inserted through the bolt holes and the slots in the dish bracket. The screw bolts have their heads located on the wing side, and the bolts are screwed into nuts on the dish bracket side, whereby the dish antenna can keep the adjusted rotation angle. (Although not shown or described in the U.S. patent, the nuts should be used on the bracket side in order to fasten the bolts.) Each wing is provided with an elevation adjusting mechanism. The azimuth clamp is disposed between the wings.

With the above-described arrangement of the rotation apparatus, in order to maintain the rotation angle, the bolts are inserted from the elevation bracket side to extend to the dish bracket side, and the bolts are screwed to the nuts on the dish antenna side of the dish-elevation bracket assembly. This makes it troublesome to manufacture the rotation apparatus. An object of the present invention is to provide a dish antenna rotation apparatus which can be manufactured easily.

SUMMARY OF THE INVENTION

The dish antenna rotation apparatus according to the present invention includes an antenna bracket. The antenna bracket is adapted to be secured to the rear surface of a reflector of a dish antenna, e.g. an offset parabolic antenna. The antenna bracket has a planar plate having opposing major surfaces which, when the antenna bracket is secured to the reflector, lie perpendicular to a "polarity axis". The polarity axis referred to herein is an axis which is parallel to the boresight axis of the antenna connecting the apex of the parabola defining the offset parabolic antenna to the focal point of the offset parabolic antenna, and extends through the offset parabolic antenna. The planar plate is provided with a plurality of spaced-apart arcuate slots formed therein along an imaginary circle drawn on the plate about the polarity axis. The arcuate slots preferably extend the same angular length.

An adapter plate is disposed in contact with the dish antenna side of the planar plate. The adapter plate is arranged such that the antenna bracket can be rotated about the polarity axis relative to the adapter plate. For example, a projection projecting toward the reflector may be formed in the reflector side surface of the planar plate of the antenna bracket. The projection is inserted into a hole formed in the adapter plate. Alternatively, a hole may be formed in the surface of the planar plate facing the reflector, with a projection projecting from the adapter plate toward the planar plate inserted into the hole. The adapter plate is provided with engagement portions in alignment with the arcuate slots.

An elevation bracket is disposed on the surface of the planar plate facing away from the reflector. The elevation bracket has a pair of wings, which extend perpendicular to the planar plate of the antenna bracket and in parallel with each other. A connecting member is formed integral with and perpendicular to the pair of wings. The elevation bracket is rotatable about an elevation adjustment axis passing through the wings in the direction perpendicular to the wings.

The elevation bracket further includes tabs which are adapted to contact the planar plate. The number of the tabs is equal to the number of the arcuate slots. The tabs have holes in alignment with the arcuate slots. The connecting member may be perpendicular also to the planar plate. In this case, the tabs are formed at the end of the wings and the connecting member on the planar plate side and extend outward of the elevation bracket.

Securing members extend through the holes in the tabs and the arcuate slots and engage with the engagement portions of the adapter plate for securing the elevation bracket and the antenna bracket to the adapter plate. The securing members may be bolts inserted into the holes in the tabs and the slots in the antenna bracket from the elevation bracket side so that their heads rest on the surfaces of the respective tabs facing away from the reflector. In this case, the engagement portions are in the form of screw holes in the adapter plate.

BEST MODE OF THE INVENTION

Figure 1:
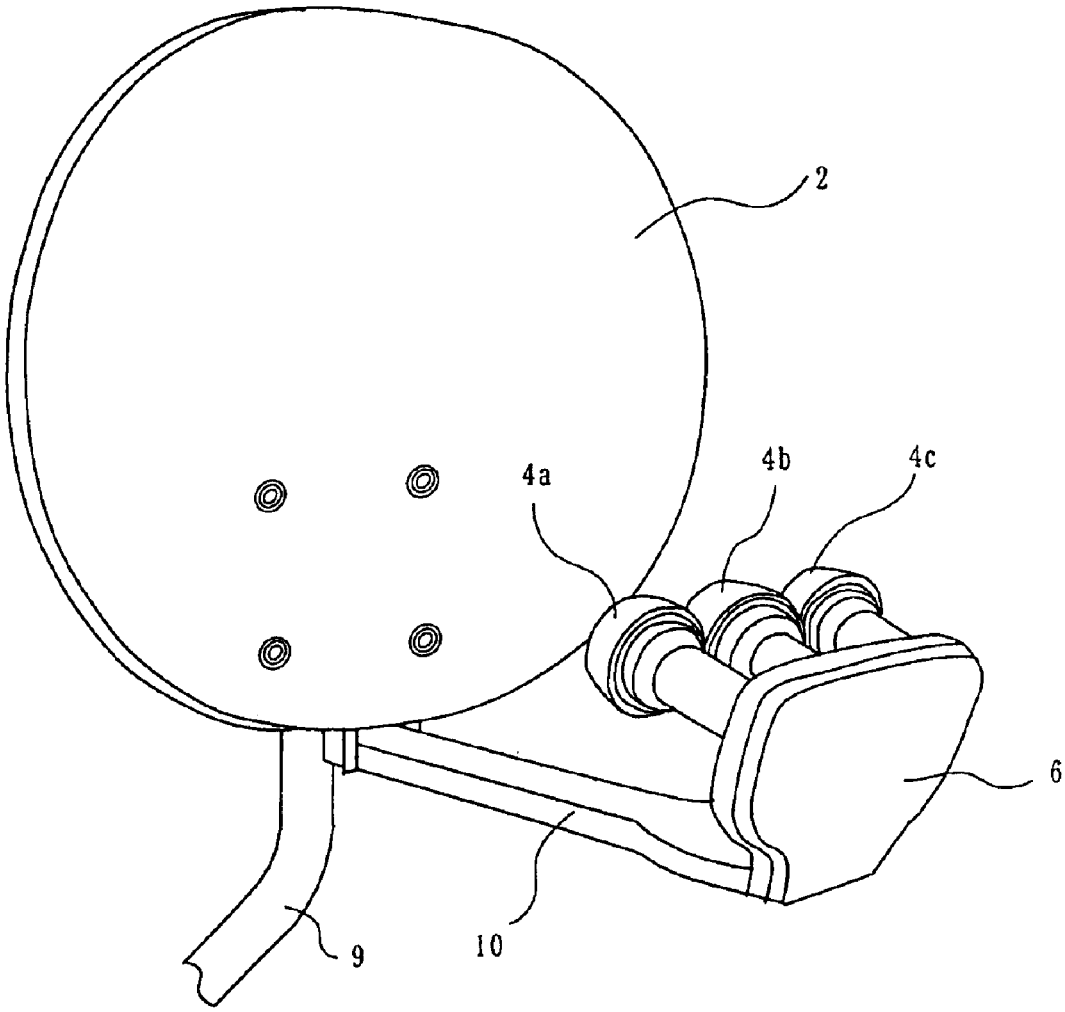
FIG. 1 is a front perspective view of an offset parabolic antenna with a dish antenna rotation apparatus according to one embodiment of the present invention.

A dish antenna with an antenna rotation apparatus according to an embodiment of the present invention may be a multi-beam antenna as shown in FIG. 1. The multi-beam antenna includes an offset parabolic reflector 2, and a low noise block converter 6 with plural, e.g. three, primary radiators 4*a*, 4*b* and 4*c* disposed in the vicinity of the focal point of the reflector 2. The three primary radiators 4*a*, 4*b* and 4*c* are for three stationary satellites, e.g. broadcasting satellites, at locations in the space defined by given longitudes and latitudes, for example, at locations above the equator.

Figure 3:
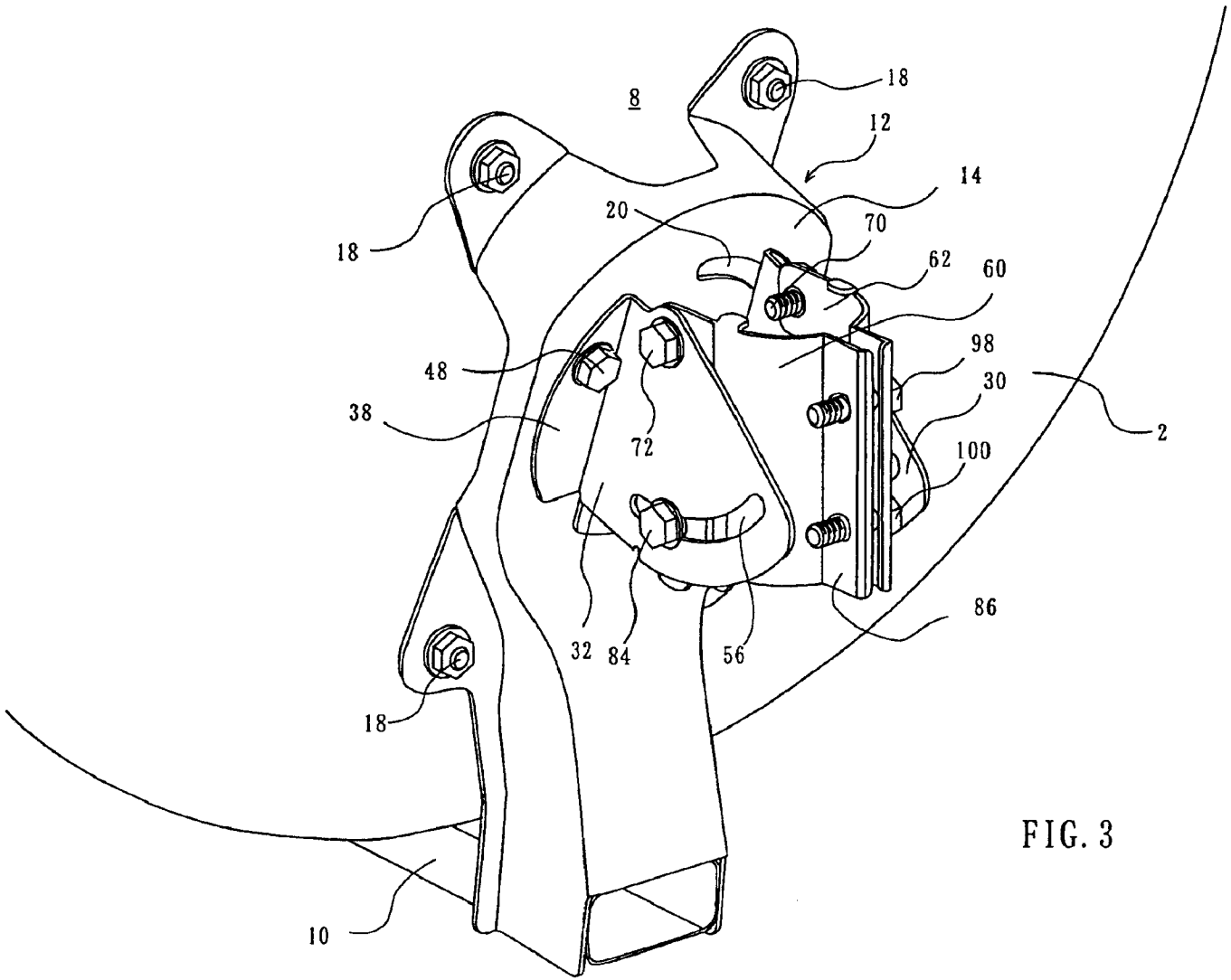
FIG. 3 is a rear perspective view of part of the antenna of FIG. 1.

A rotation, elevation and azimuth adjustment apparatus 8 for allowing adjustment of the rotation, elevation, and azimuth of the antenna is secured to the rear surface of the reflector 2, as shown in FIG. 3. The converter 6 is mounted on an arm 10 extending forward of the reflector 2 from the lower end of the adjustment apparatus 8. The rotation, elevation and azimuth adjustment apparatus 8 is adapted to be secured to a mast 9, as shown in FIG. 1.

The offset parabolic reflector 2 has such a shape that radio waves for the respective primary radiators 4*a*, 4*b* and 4*c* can arrive at the respective radiators 4*a*, 4*b* and 4*c*, and is tailored to have its center axis located at the lower end center of the reflector 2.

Figure 2:
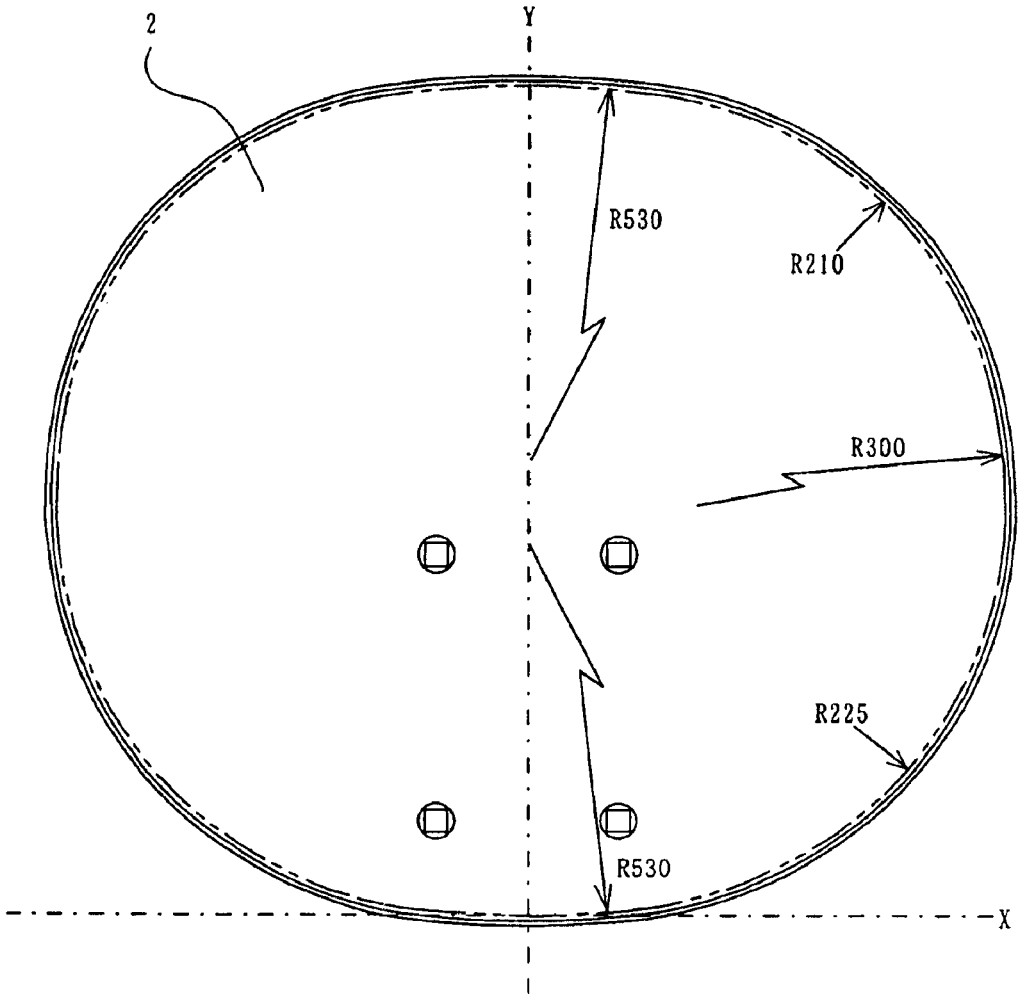
FIG. 2 is a front view of a reflector of the antenna of FIG. 1.

The aperture contour of the reflector 2 is shown in FIG. 2. When the axes extending in the horizontal and vertical direction through the lower end center, i.e. the origin, are referred to as X-axis and Y-axis, the aperture can be defined as follows.

$X^2+(Y-229.4)^2=530^2$, when the absolute value of $X \leqq 59.2710$ mm, and $Y<229.4$ mm.

$(X-34.1088)^2+(Y-226.9132)^2=225^2$, when $59.2710$ mm$<X \leqq 258.9850$ mm.

$(X+34.1088)^2+(Y-226.9132)^2=255^2$, when $-59.2710$ mm$>X \geqq -258.9850$ mm, and $Y<229.4$ mm.

$(X+40.85)^2+(Y-229.4)^2=300^2$, when $254.4805$ mm$\leqq X$, and $Y>229.4$ mm.

$(X-40.85)^2+(Y-229.4)^2=300^2$, when $-254.4805$ mm$\geqq X$, and $Y>229.4$ mm.

$(X-47.749)^2+(Y-245.2175)^2=210^2$, when $79.0845$ mm$\leqq X<249.4805$ mm, and $Y>229.4$ mm.

$(X+47.749)^2+(Y-245.2175)^2=210^2$, when $-79.0845$ mm$\leqq X>-249.4805$ mm, and $Y>229.4$ mm.

$X^2+(Y+71.2)^2=530^2$, when the absolute value of $X \leqq 79.0845$ mm, and $Y>229.4$ mm.

Figure 5:
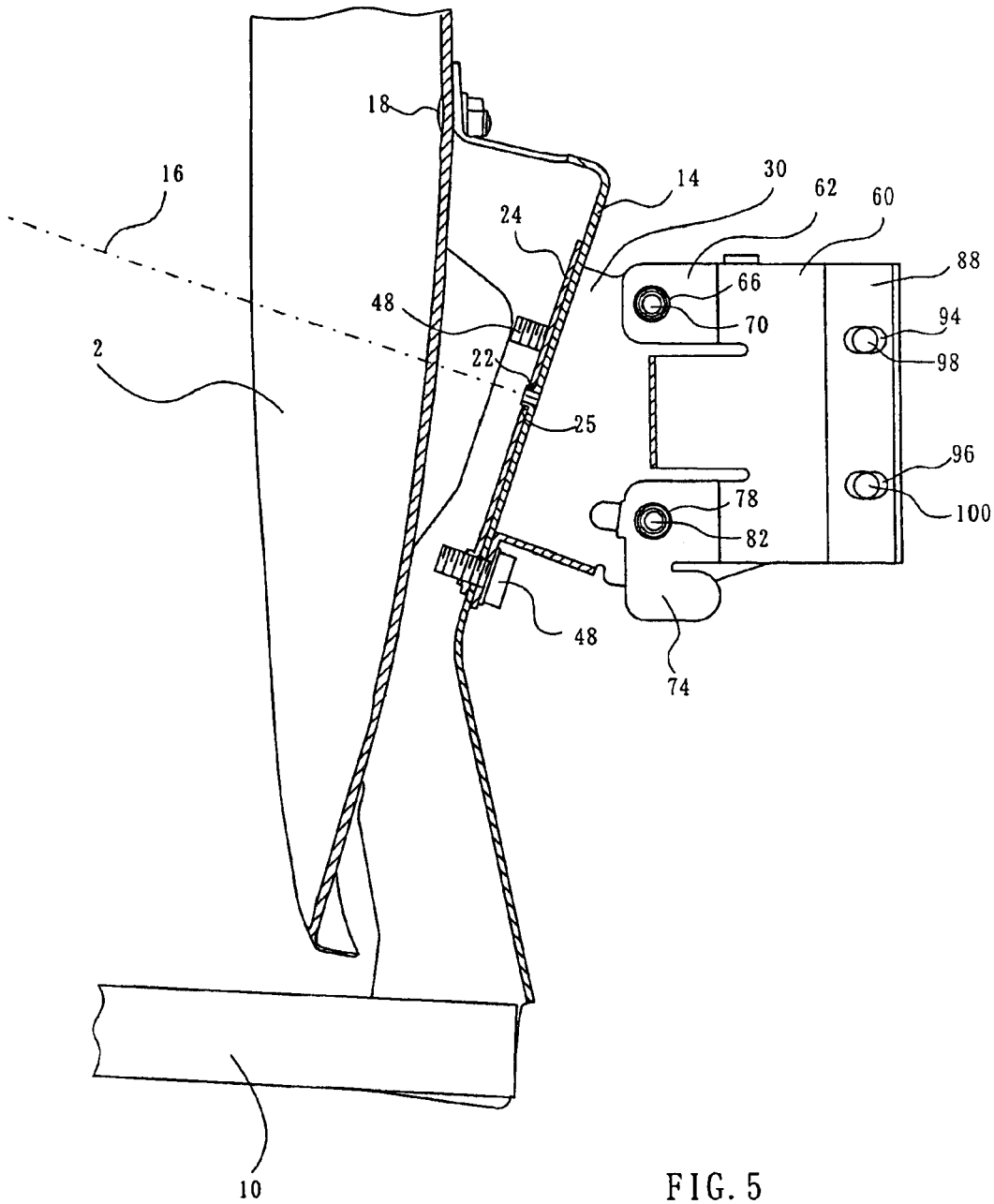
FIG. 5 shows a longitudinal cross-section of part of the antenna of FIG. 1.

As shown in FIG. 3, a dish bracket 12 of the rotation, elevation and azimuth adjustment apparatus 8 is detachably fixed to the rear surface of the offset parabolic reflector 2. The dish bracket 12 has a planar portion 14. As is seen in FIG. 5, the planar portion 14 is spaced from the rear surface of the reflector 2 and is position to be perpendicular to a polarity axis 16 which is parallel to a line interconnecting the apex of the reflector 2 (i.e. the origin shown in FIG. 2) and the focal point of the reflector 2. The dish bracket 12 extends from the lower portion of the planar portion 14 to a location beyond the lower edge of the reflector 2, where its lower end is secured to the arm 10. The dish bracket 12 is fixed detachably to the reflector 2 by bolts 18.

Figure 4:
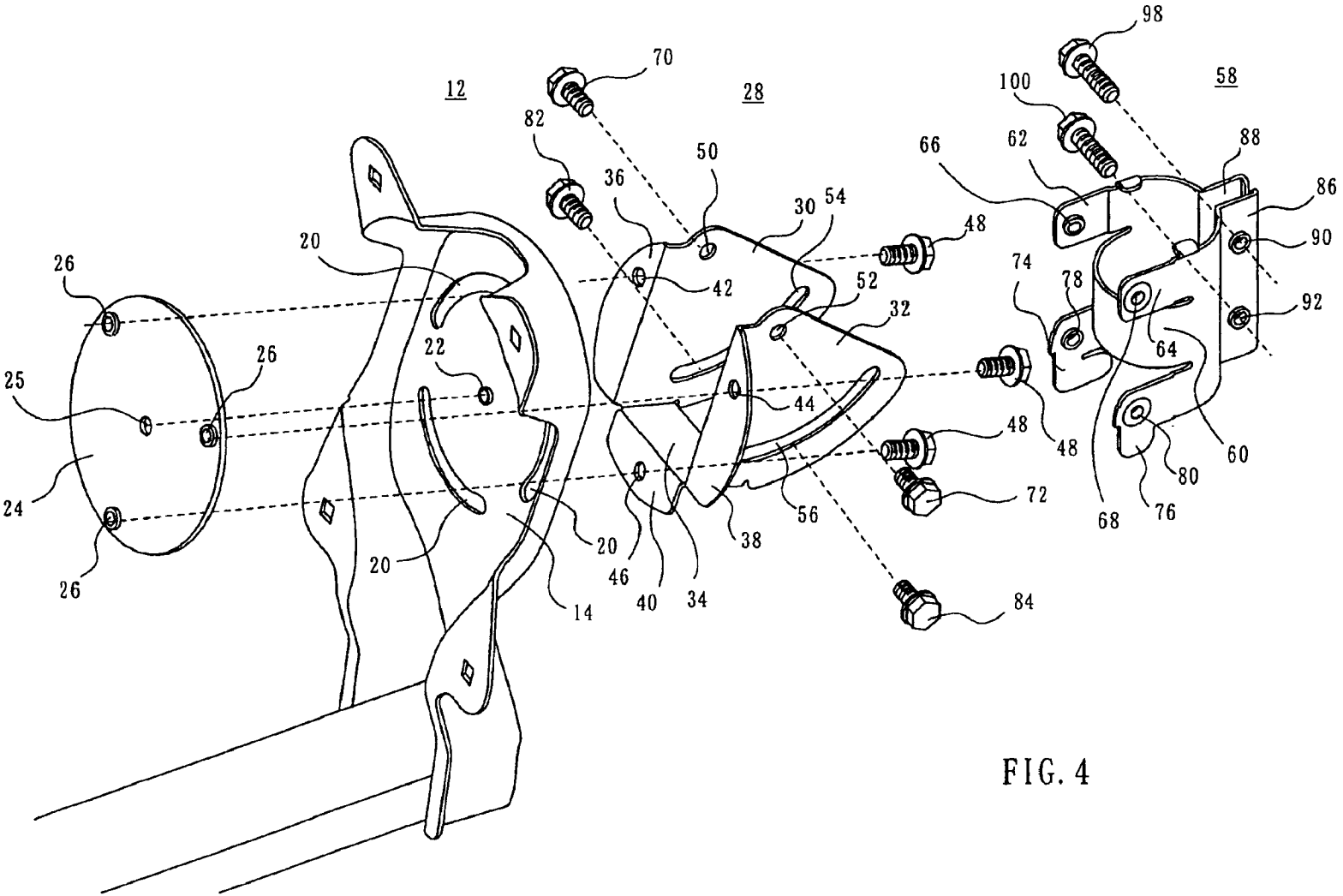
FIG. 4 is an exploded view of the dish antenna rotation apparatus shown in FIG. 1.

As shown in FIG. 4, plural, for example, three, arcuate slots 20 are formed in the planar portion 14. The arcuate slots 20 are arranged on an imaginary circle of a give radius drawn with its center located on the point where the polarity axis 16 intersects the planar portion 14. The arcuate slots 20 have the same shape. The centers of the respective slots are angularly spaced from each other by an equal amount. In the illustrated example, the centers of the three arcuate slots are spaced from the adjacent ones by 120°. The slots 20 extend through the thickness of the planar portion 14.

A projection 22 is formed on the planar portion 14. The projection 22 projects from the center of the above-mentioned imaginary circle toward the reflector 2. An adapter plate 24 is disposed on the surface of the planar portion 14 facing the reflector 2. The adapter plate 24 may be disk-shaped. A through-hole 25 is formed at the center of the adapter plate 24, which the projection 22 can be fit into. With the projection 22 fitted into the hole 25, the dish bracket 12 and the reflector 2 can rotate about the polarity axis 16. Plural, for example, three, engagement portions, for example, screw holes 26, are formed in the adapter plate 24 at locations on a second imaginary circle drawn with the same radius as the imaginary circle drawn on the planar portion 14. The second imaginary circle has its center located at the center of the hole 25. The centers of the screw holes 26 are equally angularly spaced from each other by the same angle by which the centers of the arcuate slots 20 are mutually angularly spaced. Thus, the screw holes 26 are associated with the respective arcuate slots 20. In the illustrated example, the angular spacing of the screw holes 26 is 120°.

The rotation, elevation and azimuth adjustment apparatus 8 further has an elevation bracket 28. The elevation bracket 28 is mounted to the rear surface of the dish bracket 12. The elevation bracket 28 has a pair of wings 30 and 32. The wings 30 and 32 have the same, generally sectorial shape. The wings 30 and 32 are spaced from each other and disposed perpendicular to the planar portion 14 with corresponding straight edges of the sectors in contact with the planar portion 14 of the dish bracket 12. The wings 30 and 32 are connected together by a connecting member 34, which is formed between the lower edges of the wings 30 and 32 and extends perpendicular to the wings 30 and 32 and also to the planar portion 14.

Tabs 36, 38 and 40 extend from those edges of the wings 30 and 32 and the connecting member 34 which face the planar portion 14 of the dish bracket 12. The tabs 36, 38 and 40 extend outward of the bracket 28 and are perpendicular to the associated ones of the wings 30 and 32 and connecting member 34 so that they can contact with the planar portion 14. The locations of the tabs 36, 38 and 40 are in alignment with associated ones of the arcuate slots 20. Through-holes 42, 44 and 46 are formed in the tabs 36, 38 and 40, respectively, and equiangularly disposed on the imaginary circle along which the arcuate slots 20 are disposed. Thus, in the illustrated example, the angular spacing of the through-holes 42, 44 and 46 is 120°.

Securing members, e.g. bolts 48, are inserted into the through-holes 42, 44 and 46 and the respective arcuate slots 20 to engage with the respective screw holes 26 in the adapter plate 24. The bolts 48 have their heads positioned on the surfaces of the respective tabs 36, 38 and 40 facing away from the reflector 2. When the bolts 48 are screwed tight into the screw holes 26, the elevation bracket 28 can be firmly secured to the planar portion 24 of the dish bracket 12. When, however, the elevation bracket 28 is fixed to the dish bracket 12 with the bolts 48 somewhat loosened, the dish bracket 12 and the reflector 2 can be rotated about the polarity axis 16. Although not shown, angle indices are formed along one of the slots 20. The angle indices can be referenced to when the bracket 12 and the reflector 2 are rotated about the polarity axis 16.

At the pivots of the sectorial wings 30 and 32, bolt or pivot holes 50 and 52 are formed. Arcuate slots 54 and 56 with their centers located at the centers of the pivot holes 50 and 52, respectively, are formed along the arcuate edges of the wings 30 and 32. The slots 54 and 56 extend through the respective wings 30 and 32.

Also, the rotation, elevation and azimuth adjustment apparatus 8 includes an azimuth clamp 58. The azimuth clamp 58 is adapted to be disposed between the wings 30 and 32 of the elevation bracket 28. As shown in FIG. 4, the azimuth clamp 58 has a cylindrical portion 60, through which the mast 9 is adapted to extend. Tabs 62 and 64 extend from the upper end of the cylindrical portion 60 toward the reflector 2. The tabs 62 and 64 are provided with screw holes 66 and 68, respectively. After positioning the azimuth clamp 58 in place between the wings 30 and 32, a bolt 70 is inserted into the hole 50 in the wing 30 and the hole 66 in the tab 62, and also a bolt 72 is inserted into the hole 52 in the wing 32 and the hole 68 in the tab 64. The elevation bracket 28 is rotatable about an axis extending through the bolts 70 and 72 to adjust the angle of elevation of the reflector 2. Also, tabs 74 and 76 are formed in the lower end portion of the cylindrical portion 60 to extend toward the reflector 2. Screw holes 78 and 80 are provided in the tabs 74 and 76, respectively. A bolt 82 is inserted into the arcuate slots 54 in the wing 30 and screwed into the hole 78, while a bolt 84 is inserted into the arcuate slots 56 in the wing 32 and screwed into the hole 80. Although not shown, angle indices are formed in the wings 30 and 32 along the slots 54 and 56, for use in adjusting the angle of elevation of the reflector 2. The angle of elevation of the reflector 2 is adjusted by rotating the elevation bracket 28 about the bolts 70 and 72 so as to place the bolts 82 and 84 at the indices indicating a desired angle of elevation. After the adjustment, the bolts 70, 72, 82 and 84 are fastened.

A cut is formed in the portion of the cylindrical portion 60 remotest from the reflector 2 to extend longitudinally from the upper edge to the lower edge of the cylindrical portion 60. Tabs 86 and 88 extend away from the reflector 2 from the opposing edges of the cut. Screw holes 90 and 92 are formed in the tab 86, being spaced in the length direction of the tab 86, and through-holes 94 and 96 are formed in the tab 88 at the locations corresponding to the locations of the screw holes 90 and 92 in the tab 86. Bolts 98 and 100 are adapted to be screwed through the through-holes 94 and 96 into the screw holes 90 and 92, respectively, so as to firmly secure the azimuth clamp 58 to the mast 9. With this arrangement, the azimuth clamp 58 is rotated about the mast 9, with the bolts 98 and 100 loosened, so as to orient the reflector 2 to a desired azimuth. After that, the bolts 98 and 100 are firmly fastened so as to keep the desired azimuth for the reflector 2.

When assembling the rotation, elevation and azimuth adjustment apparatus 8, first the projection 22 of the dish bracket 12 is inserted into the through-hole 25 in the adapter plate 24, and the adapter plate 24 is rotated so as to align the respective screw holes 26 with the respective arcuate slots 20 in the planar portion 14 of the dish bracket 12. Then, the tabs 36, 38 and 40 of the elevation bracket 28 are placed on the surface of the planar portion 14 opposite to the surface on which the adapter plate 24 is disposed. The through-holes 42, 44 and 46 in the tabs 36, 38 and 40 are aligned with the arcuate slots 20. After that, the bolts 48 are loosely screwed through the through-holes 42, 44 and 46, and the respective slots 20 into the respective screw holes 26, to thereby couple the adapter plate 24, the dish bracket 12 and the elevation bracket 28.

Then, the azimuth clamp 58 is placed between the wings 30 and 32 of the elevation bracket 28, and the bolts 70 and 72 are inserted through the through-holes 50 and 52, respectively, and loosely screwed into the respective screw holes 66 and 68. After that, the bolts 82 and 84 are inserted into the slots 54 and 56 in the respective wings 30 and 32, and loosely screwed into the screw holes 78 and 80.

The bolts 98 and 100 are then inserted into the through-holes 94 and 96, respectively, in the tab 88 of the azimuth clamp 58 and loosely screwed into the respective screw holes 90 and 92 in the tab 86 of the clamp 58.

The rotation, elevation and azimuth adjustment apparatus 8 assembled to the extent described above is shipped together with the offset parabolic reflector 2.

The adjustment apparatus 8 is secured to the offset parabolic reflector 2 after it is brought to a place where the offset parabolic antenna is to be installed, by first coupling the dish bracket 12 to the back of the reflector 2 by means of the bolts 18. Next, the mast 9 is inserted into the cylindrical portion 60 of the azimuth clamp 58. The dish bracket 12 and the reflector 2 are rotated about the projection 22 to attain a desired rotation angle, and, the bolts 48 are fastened. The cylindrical portion 60 is rotated about the mast 9 and, also, the elevation bracket 28 is rotated about the bolts 70 and 72 to such a position that an appropriate radio wave can be received in a good condition at one of the three primary radiators 4*a*, 4*b* and 4*c*, e.g. the primary radiator 4*a*. After that, the bolts 70, 72, 82, 84, 98 and 100 are fastened.

Since the wings 30 and 32 of the elevation bracket 28 of the rotation, elevation and azimuth adjustment apparatus 8 with the above-described structure are joined together by means of the connecting member 34, the positional relation of the wings 30 and 32 is fixed and does not change. In addition, the positional relation of the elevation bracket 28 to the dish bracket 12 does not change even when the bolts 48 are fastened, with the bolts 70, 72, 82 and 84 loosened, since the through-holes 42, 44 and 46 in the tabs 36, 38 and 40 are in alignment with the respective screw holes 26 in the adapter plate 14. Also, the fixing of the elevation bracket 28 to the dish bracket 12 is easy since it can be effected by simply screwing the bolts 48 into the screw holes 26, and this screwing operation can be done on the elevation bracket side. If through-holes were formed, instead of the screw holes 26 in the adapter plate 24, nuts should be placed at the locations corresponding to such through-holes on the surface of the adapter plate 24 facing the reflector 2, in order to secure the elevation bracket 28 to the dish bracket 12 by means of the bolts 48. Such fixing operation is very troublesome.

In the above-described example, the adapter plate 24 is disk-shaped, but an adapter plate of different shape, for example, a rectangular plate may be used instead. Also, the number of the screw holes 26 and the arcuate slots 20 is three (3), but it may be changed as occasion demands.

What is claimed is:

1. A dish antenna rotation apparatus comprising:

a dish bracket adapted to be fixed to a rear surface of a dish antenna, said dish bracket including a planar plate having opposing major surfaces which, when said dish bracket is fixed to the rear surface of said dish antenna, lie perpendicular to a polarity axis, said planar plate having a plurality of arcuate slots formed therein, being spaced from each other on an imaginary circle drawn about said polarity axis on said planar plate;

an adapter plate disposed to contact with one of said major surfaces of said planar plate facing said dish antenna and arranged such that said dish bracket can be rotated about said polarity axis relative to said adapter plate, said adapter plate being provided with a plurality engagement portions in alignment with said respective arcuate slots in said planar plate;

an elevation bracket disposed on the other of said opposing major surfaces of said planar plate facing away from said dish antenna, including a pair of parallel, spaced-apart wings extending perpendicular to said planar plate, and a connecting member formed integral with said pair of wings, said connecting member extending in parallel with said wings, said elevation bracket being rotatable about an elevation adjustment axis extending between said wings and perpendicular to said wings;

said elevation bracket including tabs equal in number to said arcuate slots in said planar plate, said tabs being in contact with said planar plate and being provided with holes in alignment with said arcuate slots; and a plurality of securing members extending through said holes in said tabs and said arcuate slots in alignment with said holes and engaging with said engagement portions of said adapter plate to thereby secure said elevation and dish brackets to said adapter plate.

2. The dish antenna rotation apparatus according to claim 1 wherein said securing members are bolts, said bolts being inserted to extend through said holes in said tabs and said arcuate slots from the elevation bracket side; and said engagement portions are screw holes formed in said adapter plate.

3. The dish antenna rotation apparatus according to claim 1 wherein the arrangement for allowing said dish bracket to be rotatable about said polarity axis relative to said adapter plate comprises a projection projecting in alignment with said polarity axis from said one major surface of said planar plate toward said dish antenna, and an opening formed in said adapter plate to receive said projection.

4. The dish antenna rotation apparatus according to claim 1 wherein said connecting member is also perpendicular to said planar plate, and said tabs are formed in edges of said wings and connecting member and extend outward from said elevation bracket.

* * * * *